US009926951B2

(12) United States Patent
Ooki et al.

(10) Patent No.: US 9,926,951 B2
(45) Date of Patent: Mar. 27, 2018

(54) ENERGY REGENERATION SYSTEM FOR CONSTRUCTION MACHINE

(71) Applicant: Hitachi Construction Machinery Co., Ltd., Tokyo (JP)

(72) Inventors: Takatoshi Ooki, Kasumigaura (JP); Seiji Hijikata, Tsukuba (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 249 days.

(21) Appl. No.: 14/771,589

(22) PCT Filed: Jul. 24, 2014

(86) PCT No.: PCT/JP2014/069527

§ 371 (c)(1),
(2) Date: Aug. 31, 2015

(87) PCT Pub. No.: WO2015/012340

PCT Pub. Date: Jan. 29, 2015

(65) Prior Publication Data

US 2016/0146232 A1 May 26, 2016

(30) Foreign Application Priority Data

Jul. 24, 2013 (JP) ..... 2013-153889

(51) Int. Cl.
*F15B 21/14* (2006.01)
*E02F 9/12* (2006.01)
(Continued)

(52) U.S. Cl.
CPC ..... *F15B 21/14* (2013.01); *E02F 9/123* (2013.01); *E02F 9/2075* (2013.01);
(Continued)

(58) Field of Classification Search
CPC ..... E02F 9/2075; E02F 9/2217; E02F 9/2285; E02F 9/2296; E02F 9/123; F15B 21/14
(Continued)

(56) References Cited

U.S. PATENT DOCUMENTS 6,460,332 B1 * 10/2002 Maruta ..... E02F 9/2075 60/414
8,510,000 B2 * 8/2013 Kawasaki ..... E02F 9/2075 180/275

(Continued)

FOREIGN PATENT DOCUMENTS

EP 2 770 219 A1 8/2014
JP 2004-116656 A 4/2004

(Continued)

OTHER PUBLICATIONS

Extended European Search Report issued in counterpart European Application No. 14829246.9 dated Mar. 22, 2017 (9 pages).

(Continued)

*Primary Examiner* — Michael Leslie
*Assistant Examiner* — Richard Drake
(74) *Attorney, Agent, or Firm* — Crowell & Moring LLP

(57) ABSTRACT

Energy regeneration system does not affect operation of a hydraulic actuator except when a relief valve is operating, by connecting an actuator hydraulic line to a regeneration hydraulic motor with a small pressure loss during regeneration, and ensures holding pressure when the energy cannot be regenerated. A first valve device disposed between actuator hydraulic lines and a regeneration hydraulic motor, has a throttle passage capable of increasing pressure in the higher pressure side actuator hydraulic line to a set pressure of the relief valves. A second valve device disposed in parallel with the first valve device between the actuator hydraulic lines and the regeneration hydraulic motor, is (Continued)

switched from a close to an open position by pressure between the first valve device and the regeneration hydraulic motor when pressure between the first valve device and the regeneration hydraulic motor increases to approach the set pressure of the swing relief valve.

5 Claims, 8 Drawing Sheets

(51) Int. Cl.
*E02F 9/20* (2006.01)
*E02F 9/22* (2006.01)

(52) U.S. Cl.
CPC ..... *E02F 9/2217* (2013.01); *E02F 9/2285* (2013.01); *E02F 9/2296* (2013.01); *F15B 2211/7058* (2013.01)

(58) Field of Classification Search
USPC ..... 60/414, 420
See application file for complete search history.

(56) References Cited

U.S. PATENT DOCUMENTS 8,606,452 B2 * 12/2013 Kawasaki ..... E02F 9/2075 701/22
8,726,645 B2 * 5/2014 Shang ..... E02F 9/123 60/414
8,881,519 B2 * 11/2014 Kamimura ..... E02F 9/123 60/414
9,284,718 B2 * 3/2016 Hijikata ..... E02F 9/2091
2005/0246082 A1 * 11/2005 Miki ..... E02F 9/2075 701/50
2006/0090462 A1 5/2006 Yoshino
2011/0071738 A1 3/2011 Kawasaki et al.
2014/0325975 A1 * 11/2014 Kim ..... F15B 21/14 60/414

FOREIGN PATENT DOCUMENTS

JP 2009-281525 A 12/2009
JP 2011-220390 A 11/2011
WO WO 2013/057919 A1 4/2013

OTHER PUBLICATIONS

Notification of Transmittal of Translation of the International Preliminary Report on Patentability (Chapter I or Chapter II), in International Application No. PCT/JP2014/069527, dated Feb. 4, 2016.

* cited by examiner

ENERGY REGENERATION SYSTEM FOR CONSTRUCTION MACHINE

TECHNICAL FIELD

The present invention relates to an energy regeneration system provided for construction machines such as hydraulic excavators and controlling recovery of energy of the construction machines.

BACKGROUND ART

Construction machines such as hydraulic excavators include as a power source an engine that uses gasoline and light oil for its fuel, for example. This engine drives a hydraulic pump to generate hydraulic pressure and drives actuators such as hydraulic motors and hydraulic cylinders. Hydraulic actuators are small in size and weight but can output significant power, and for this reason, they are widely used as actuators for construction machines.

Construction machines such as hydraulic excavators include a swing structure. In a hydraulic excavator that uses a hydraulic motor to drive a swing structure, when a swing control lever returns to a neutral position during swing operation, a hydraulic line adapted to supply hydraulic fluid to the hydraulic motor is closed by a control valve. The swing structure is brought into a decelerated state by relief operation of a relief valve and then into a stop state.

In the conventional hydraulic excavators, all the energy of the hydraulic fluid discharged from relief valves was wasted as heat. Patent document 1 proposes an energy regeneration system in which a regeneration device composed of a hydraulic pump and an electric motor recovers the energy of the hydraulic fluid discharged from the relief valve and effectively uses it.

Patent document 1 has a safety valve installed between a swing hydraulic motor and the regeneration device. Only when an operation device is in a neutral state and a brake pressure not lower than a predetermined pressure is detected, the passage resistance in the safety valve can be reduced by an electric signal from a controller.

PRIOR ART DOCUMENT

Patent Document

Patent Document 1: JP-2009-281525-A

SUMMARY OF THE INVENTION

Problem to be Solved by the Invention

The energy regeneration system needs to block or sufficiently restrict the hydraulic line from the swing hydraulic motor to the regeneration device during swing operation except when relief valve operates in order to prevent the leak or other factors of the regeneration device from affecting the swing operation. It is however desirable to reduce passage resistance of the hydraulic line leading from the swing hydraulic motor to the regeneration device so that the energy is regenerated without a loss during the regeneration. For that purpose, the energy regeneration system described in patent document 1 is provided with a safety valve between the swing hydraulic motor and the regeneration device. Only when the operation device is in a neutral state and a brake pressure not lower than the predetermined pressure is detected, the passage resistance in the safety valve can be reduced in response to electric signals from the controller.

However, the energy regeneration system in patent document 1 controls the passage resistance in the safety valve using the electric signals from the controller. For this reason, the passage resistance in the safety valve may not increase because of possible troubles in the electric system or runaway of the controller. Such troubles may fail to ensure the holding pressure of the swing structure.

It is an object of the present invention to provide an energy regeneration system that does not affect operation of a hydraulic actuator except when a relief valve operates, improves energy recovery efficiency by connecting an actuator hydraulic line to a regeneration hydraulic motor with a small pressure loss during regeneration, and ensures the holding pressure of the hydraulic actuator when the energy cannot be regenerated, thereby preventing unintended operation.

Means for Solving the Problem (1) To achieve the above object, the present invention is an energy regeneration system for a construction machine, including: a hydraulic pump; a hydraulic actuator driven by hydraulic fluid supplied from the hydraulic pump; a control valve that supplies the hydraulic fluid from the hydraulic pump to the hydraulic actuator in response to an operation command of an operation device so as to control a drive direction and speed of the hydraulic actuator; relief valves installed on two actuator hydraulic lines connecting the control valve and the hydraulic actuator together, the relief valve being adapted to control pressures in the actuator hydraulic lines not to exceed a set pressure; a regeneration hydraulic motor rotationally driven by a hydraulic fluid discharged from a higher pressure side of the two actuator hydraulic lines when pressure in the higher pressure side actuator hydraulic line increases to the set pressure of the relief valve; and a regeneration energy recovery device, connected to the regeneration hydraulic motor, for recovering output power of the regeneration hydraulic motor; wherein the energy regeneration system further comprising: a first valve device disposed between the regeneration hydraulic motor and at least the higher pressure side actuator hydraulic line, the first valve device having a throttle passage allowing the pressure in the higher pressure side actuator hydraulic line to increase to the set pressure of the relief valve; and a second valve device disposed in parallel with the first valve device between the regeneration hydraulic motor and at least the higher pressure side of the two actuator hydraulic lines, the second valve device being adapted to be switched from a close position to an open position by the pressure between the first valve device and the regeneration hydraulic motor when the pressure between the first valve device and the regeneration hydraulic motor increases to approach the set pressure of the relief valve.

In the present invention configured as above, the first valve device and the second valve device are disposed in parallel between the regenerator hydraulic motor and at least the higher pressure side of the two actuator hydraulic lines. The first valve device is provided with the throttle passage allowing the pressure in the higher pressure side actuator hydraulic line to increase to the set pressure of the relief valve. When the pressure between the first valve device and the regeneration hydraulic motor increases to approach the set pressure of the relief valve, the second valve device is switched from the close position to the open position by the pressure between the first valve device and the regeneration hydraulic motor. This configuration does not affect operation of the hydraulic actuator except when the relief valve is operating, improving energy recovery efficiency by connecting the actuator hydraulic line to the regeneration hydraulic motor with a small pressure loss during regeneration. The configuration ensures the holding pressure of the hydraulic actuator when the energy cannot be regenerated and thus prevents unintended operation. Additionally, since the first valve device and the second valve device are controlled by hydraulic pressure signals, the configuration has few failure factors, thus offering high reliability.

(2) In above (1), preferably, the first valve device is a hydraulic pilot switching valve that is switched from a close position to an open position including the throttle passage when the pressure in the higher pressure side actuator hydraulic line increases to approach the set pressure of the relief valve.

While the first valve device (the hydraulic pilot switching valve) is located at the close position, an amount of leak from the regeneration hydraulic motor is limited to nearly zero. Therefore, the energy loss is reduced during the operation with a pressure not higher than the set pressure.

(3) In above (1), preferably, the first valve device is a relief valve that activates the throttle passage when the pressure in the higher pressure side actuator hydraulic line increases to approach the set pressure of the relief valve.

Before the first valve device (the relief valve) relieves hydraulic pressure, the amount of leak from the regeneration hydraulic motor is limited to nearly zero. Therefore, the energy loss is reduced during the operation with a pressure not higher than the set pressure.

(4) In above (1), preferably, the first valve device is a fixed restrictor forming the throttle passage.

This can simplify the configuration of the first valve device.

(5) In above (1) to (4), preferably, the energy regeneration system for a construction machine further includes: a pressure sensor for detecting pressure between the first valve device and the regeneration hydraulic motor; and a control unit that controls the regeneration hydraulic motor or the regeneration energy recovery device so as to keep the rotational speed of the regeneration hydraulic motor at zero until the pressure detected by the pressure sensor reaches a predetermined pressure at which operation of the hydraulic actuator is not affected, and so as to rotate the regeneration hydraulic motor and hold the pressure detected by the pressure sensor at the predetermined pressure when the pressure detected by the pressure sensor exceeds the predetermined pressure.

This ensures the brake pressure of the hydraulic actuator during the regeneration as well, thus enabling control with a high degree of reliability without affecting the operation during braking.

Advantageous Effects of the Invention

The present invention does not affect operation of the hydraulic actuator except when the relief valve is operating, improves energy recovery efficiency by connecting the actuator hydraulic line to the regeneration hydraulic motor with a small pressure loss during regeneration, and ensures the holding pressure of the hydraulic actuator when the energy cannot be regenerated, thereby preventing unintended operation.

MODE FOR CARRYING OUT THE INVENTION

The embodiments of the present invention will hereinafter be described with reference to the drawings.

First Embodiment

Configuration

Figure 1:
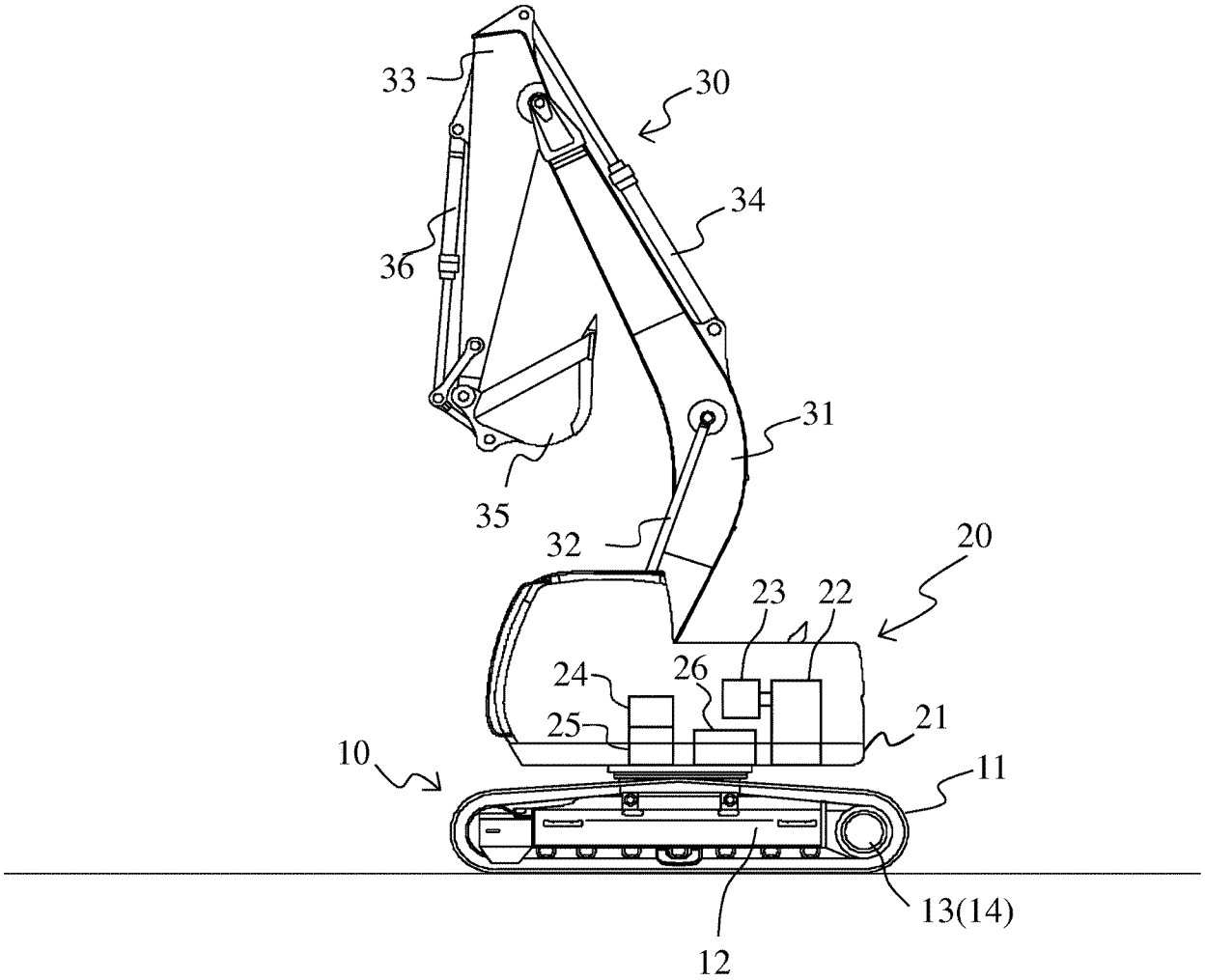
FIG. 1 shows a configuration of a hydraulic excavator as one example of construction machines provided with an energy regeneration system of the present invention.

FIG. 1 illustrates the configuration of a hydraulic excavator as one example of construction machines provided with an energy regeneration system according to the present invention.

In FIG. 1, a hydraulic excavator includes a lower track structure 10, an upper swing structure 20, and an excavating mechanism 30. The lower track structure 10 includes a pair of crawlers 11 and a pair of crawler frames 12 (only one side is shown), a pair of hydraulic motors 13 and 14 for travel (only one side is shown), and speed-reducing mechanisms (not shown) of the hydraulic motors, which motors and mechanisms control each drive of the crawlers independently.

The upper swing structure 20 includes a swing frame 21. An engine 22, a hydraulic pump 23 driven by the engine 22, a swing hydraulic motor 24, a speed reducer 25, a control valve 26, etc. are mounted on the swing frame 21. A swing mechanism (not shown) including a swing ring, etc. is installed between the lower track structure 10 and the upper swing structure 20. The speed reducer 25 reduces rotational speed of the swing hydraulic motor 24 and transmits the reduced rotation to the swing mechanism. Thus, the drive force of the swing hydraulic motor 24 drives the upper swing structure 20 to swing with respect to the lower track structure 10.

The excavating mechanism 30 includes a boom 31 rotatably supported by the upper swing structure 20 so as to be able to ascend and descend, a boom cylinder 32 for driving the boom 31, an arm 33 rotatably supported in the vicinity of the distal end of the boom 31, an arm cylinder 34 for driving the arm 33, a bucket 35 rotatably supported at the distal end of the arm 33, and a bucket cylinder 36 for driving the bucket 35. The actuators (the hydraulic motors 13, 14 for travel, the boom cylinder 32, the arm cylinder 34, the bucket cylinder 36, and the swing hydraulic motor 24) are driven by hydraulic fluid supplied from the hydraulic pump 23. Their driving directions and speeds are controlled by operating corresponding spool valves in the control valve 26.

Figure 2:
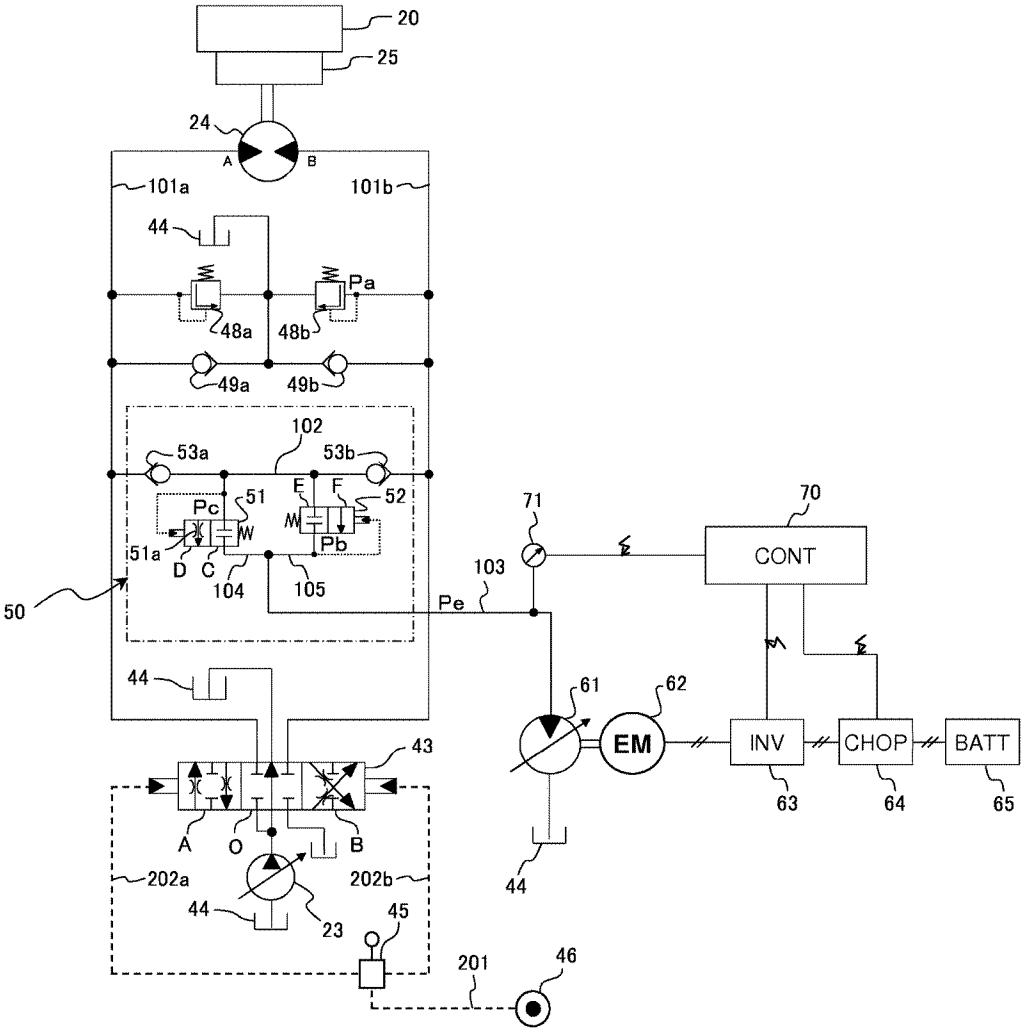
FIG. 2 is a diagram showing the overall configuration of a swing drive system of the construction machine provided with an energy regeneration system according to a first embodiment of the present invention.

FIG. 2 is a diagram showing the swing drive system provided with an energy regeneration system according to the first embodiment. In FIG. 2, the swing drive system includes the hydraulic pump 23 and the swing hydraulic motor 24 described above and a spool valve 43. The spool valve 43 controls rotational direction and speed of the swing hydraulic motor 24 by controlling the flow of the hydraulic fluid supplied from the hydraulic pump 23 to the swing hydraulic motor 24. The spool valve 43 is one of the plurality of spool valves in the control valve 26 shown in FIG. 1. The spool valve 43 is switched by operating a control lever of a swing operation device 45.

The swing operation device 45 includes a pressure reducing valve that reduces the pressure of a pilot pressure source 46 in accordance with the operation amount of a control lever. The pressure reducing valve applies an operation pilot pressure in accordance with the operation amount of the control lever to the pressure-receiving portion of the spool valve 43 via hydraulic lines 202*a*, 202*b*. The spool valve 43 is continuously switched from neutral position O to position A or B by the operation control pressure. The pilot pressure source 46 is a constant pressure source that constantly generates a constant pilot primary pressure. The pilot pressure source 46 includes a pilot pump (not shown) driven by the engine 22 (see FIG. 1) and a pilot relief valve (not shown) that keeps the discharge pressure of the pilot pump constant.

The spool valve 43 is a flow control valve having its center open. When the spool valve 43 is at neutral position O shown in the figure, the hydraulic pump 23 communicates with a tank 44 via a bleed-off throttle of the spool valve 43. The hydraulic fluid discharged by the hydraulic pump 23 returns to the tank 44 through the bleed-off throttle. The spool valve 43 is connected to port A and port B of the swing hydraulic motor 24 via two actuator hydraulic lines 101*a*, 101*b*. When the spool valve 43 is operated from neutral position O to position A, the hydraulic fluid discharged by the hydraulic pump 23 is supplied to port A of the swing hydraulic motor 24 through the meter-in throttle of position A of the spool valve 43 and the actuator hydraulic line 101*a*. Return oil from the swing hydraulic motor 24 returns to the tank 44 through the actuator hydraulic line 101*b* and the meter-out throttle at position A of the spool valve 43. Thus, the swing hydraulic motor 24 is rotated in the left direction. In contrast, when the spool valve 43 is operated from the neutral position to position B, the hydraulic fluid discharged by the hydraulic pump 23 is supplied to port B of the swing hydraulic motor 24 through the meter-in throttle at position B of the spool valve 43 and the actuator hydraulic line 101*b*. Return oil from the swing hydraulic motor 24 returns to the tank 44 through the actuator hydraulic line 101*a* and the meter-out throttle at position B of the spool valve 43. Thus, the swing hydraulic motor 24 is rotated in the right direction. When the spool valve 43 is located at between neutral position O and position A, the hydraulic fluid discharged by the hydraulic pump 23 is distributed by the bleed-off throttle and meter-in throttle of the spool valve 43. The hydraulic fluid that has passed through the meter-in throttle is supplied to the swing hydraulic motor 24. The same is true for when the spool valve 43 is located at between neutral position O and position B.

Swing relief valves 48*a*, 48*b* and check valves 49*a*, 49*b* are installed between the two actuator hydraulic lines 101*a*, 101*b* and the tank 44. The swing relief valves 48*a*, 48*b* define the maximum pressure of port A and port B of the swing hydraulic motor 24. When the spool valve 43 is operated from the neutral position in order to drive the swing hydraulic motor 24, the hydraulic fluid in the actuator hydraulic line 101*a* or 101*b* may be about to exceed the set pressure of the swing relief valves 48*a*, 48*b*. In such a case, the swing relief valve 48*a* or 48*b* will open to release the hydraulic fluid into the tank 44 and thus prevent the hydraulic fluid from reaching a pressure not lower than a set pressure. Consequently, piping of the actuator hydraulic lines 101*a*, 101*b* and hydraulic equipment such as the hydraulic motor are prevented from being broken. When the spool valve 43 is returned to the neutral position in order to stop the swing hydraulic motor 24, the hydraulic fluid in the actuator hydraulic line 101*a* or 101*b* on a side (the back pressure side) to which the hydraulic fluid is returned from the swing hydraulic motor 24 may be about to be higher than the set pressure of the swing relief valves 48*a*, 48*b*. In such a case, the swing relief valves 48*a*, 48*b* will open to release the hydraulic fluid into the tank 44. The high pressure occurring in the actuator hydraulic line 101*a* or 101*b* at that time is applied as braking pressure to the swing hydraulic motor 24 to brake and stop it. When the pressures in the actuator hydraulic lines 101*a*, 101*b* are about to be lower than the tank pressure, the check valves 49*a*, 49*b* make it possible to supply the hydraulic fluid to the actuator hydraulic line 101*a* or 101*b* from the tank 44. Consequently, cavitation is prevented in the actuator hydraulic line 101*a* or 101*b* and the swing hydraulic motor 24, etc.

The energy regeneration system in the present embodiment is provided for such a swing drive system. The energy regeneration system includes a regeneration hydraulic motor 61, a regeneration electric motor 62, and a regeneration valve block 50. The regeneration hydraulic motor 61 is rotationally driven by the hydraulic fluid discharged from the higher pressure side actuator hydraulic line 101*a* or 101*b* when pressure on the higher pressure side of the two actuator hydraulic lines 101*a*, 101*b* increases to the set pressure of the swing relief valves 48*a*, 48*b*. The regeneration electric motor 62 is a regeneration energy recovery device connected to the regeneration hydraulic motor 61 and converting the drive force of the regeneration hydraulic motor 61 into electric energy. The regeneration valve block 50 is disposed between the actuator hydraulic lines 101*a*, 101*b* and the regeneration hydraulic motor 61.

The regeneration valve block 50 has three functions as below.

1. To block or sufficiently restrict the hydraulic line leading from the swing hydraulic motor 24 to the regeneration hydraulic motor 61 except at a time of relief in which the swing relief valves 48*a*, 48*b* operate, in order to prevent leakage in the regeneration hydraulic motor 61, etc. that could affect swing operation.

2. To reduce the passage resistance of the hydraulic line leading from the swing motor to the regeneration device to allow for regeneration with an energy loss reduced as much as possible.

3. To be able to stop the swing hydraulic motor 24 without unintended operation by causing the swing relief valves 48*a*, 48*b* to operate to generate braking pressure in the event that the regeneration device (the regeneration hydraulic motor 61) has some trouble with an electric system and the regeneration hydraulic motor 61 comes into a free-run state.

To achieve the above three functions, the regeneration valve block 50 includes a first valve device 51 and a second valve device 52. The first valve device 51 is disposed between the two actuator hydraulic lines 101*a*, 101*b* and the regeneration hydraulic motor 61. The first valve device 51 has a throttle passage 51*a* that allows the pressure in the actuator hydraulic line 101*a* or 101*b* on the higher pressure side to increase to the set pressure of the swing relief valves 48*a*, 48*b*. The second valve device 52 is disposed in parallel with the first valve device 51 between the two actuator hydraulic lines 101*a*, 101*b* and the regeneration hydraulic motor 61. The second valve device 52 is switched from close position E to open position F by the pressure between the first valve device 51 and the regeneration hydraulic motor 61 when the pressure between the first valve device 51 and the regeneration hydraulic motor 61 increases to approach the set pressure of the swing relief valves 48*a*, 48*b*.

More specifically, the regeneration valve block 50 includes a first regeneration hydraulic line 102, a second hydraulic line 103, and third and fourth regeneration hydraulic lines 104, 105. The first regeneration hydraulic line 102 is connected to the actuator hydraulic lines 101*a*, 101*b* and has check valves 53*a*, 53*b* which extract the pressure on the higher pressure side of the actuator hydraulic lines 101*a*, 101*b*. The second regeneration hydraulic line 103 is connected to the regeneration hydraulic motor 61. The third and fourth regeneration hydraulic lines 104, 105 are connected between the first regeneration hydraulic line 102 and the second regeneration hydraulic line 103 and provided with the above-mentioned first valve device 51 and second valve device 52 thereon, respectively.

The first valve device 51 is a hydraulic pilot switching valve. The hydraulic pilot switching valve is located at close position C while the pressure in the actuator hydraulic line 101*a* or 101*b* on the higher pressure side is lower than a first predetermined pressure Pa. The hydraulic pilot switching valve is switched from close position C to open position D having the throttle passage 51*a* when the pressure in the actuator hydraulic line 101*a* or 101*b* on the higher pressure side increases to reach the first predetermined pressure Pa. If it is assumed that the set pressure of the swing relief valves 48*a*, 48*b* is Prmax, the first predetermined pressure Pa is set at a pressure slightly lower than Prmax. The opening area of the throttle passage 51*a* provided at open position D of the first valve device 51 is set to such a degree that, during start or stop of swing, hydraulic fluid of a low flow rate flows, the flow rate being small enough to allow the pressures in the actuator hydraulic lines 101*a* or 101*b* on the higher pressure side to increase to the set pressure Prmax of the swing relief valves 48*a*, 48*b*. The configuration of the first valve device 51 as described achieves above-mentioned function 1.

The second valve device 52 is a hydraulic pilot switching valve. The hydraulic pilot switching valve is located at close position E while the pressure in the second regeneration hydraulic line 103 between the first valve device 51 and the regeneration hydraulic motor 61 is lower than a second predetermined pressure Pb. The hydraulic pilot switching valve is switched from close position E to open position F when the pressure in the second regeneration hydraulic line 103 increases to reach the second predetermined pressure Pb. Preferably, the second predetermined pressure Pb is set to be higher than the first predetermined pressure Pa, which is the switching pressure of the first valve device 51, and lower than a regeneration pressure Pc (described later) at which regeneration hydraulic motor 61 starts rotating. It is not always necessary for the second predetermined pressure Pb to be higher than the first predetermined pressure Pa, which is the switching pressure of the first valve device 51. The second predetermined pressure Pb may be the same as or lower than the first predetermined pressure Pa as the switching pressure of the first valve device 51, as long as the second valve device 62 quickly switches to close position E when it becomes unable to regenerate the energy and thus the pressure in the second regeneration hydraulic line 103 starts falling (described later). The opening area of open position F of the second valve device 52 is set to be large enough to minimize a pressure loss caused when hydraulic fluid is discharged from the actuator hydraulic line 101*a* or 101*b* on the higher pressure side to the regeneration hydraulic motor 61 during regeneration. Such a configuration of the second valve device 52 achieves above-mentioned function 2. In addition, a combination of the above-mentioned configuration of the first valve device 51 and the above-mentioned configuration of the second valve device 52 achieves above-mentioned function 3.

In addition to the above configurations, the energy regeneration system includes an inverter 63 connected to the regeneration electric motor 62, a chopper 64 and a battery 65 connected to the inverter 63, a controller 70 connected to the inverter 63, and a pressure sensor 71 that detects the pressure in the second regeneration hydraulic line 103 and outputs the detected signal to the controller 70. If the construction machine is a hybrid hydraulic excavator, for example, the battery 65 is used as an electric source that supplies electricity to an electric motor (not shown) that assists driving the hydraulic pump 23.

The controller 70 controls the regeneration electric motor 62 via the inverter 63 so that the rotational speed of the regeneration hydraulic motor 61 is kept at zero until the pressure in the second regeneration hydraulic line 103 detected by the pressure sensor 71 reaches the third predetermined pressure Pc. When the pressure in the second regeneration line 103 exceeds the third predetermined pressure Pc, the regeneration hydraulic motor 61 is rotated to hold the pressure in the second regeneration line 103 at the third predetermined pressure Pc. The third predetermined pressure Pc is a pressure that does not affect operation (start or brake) of the swing hydraulic motor 24 when the second valve device 52 is switched to open position F and the actuator hydraulic line 101*a* or 101*b* on the higher pressure side communicates with the second regeneration hydraulic line 103. The third predetermined pressure Pc is set at a value roughly equal to or slightly lower than the set pressure Prmax of the swing relief valves 48*a*, 48*b*. In short, the relationship of "Prmax>Pc>Pb>Pa" is established. By setting the regeneration pressure and controlling the regeneration hydraulic motor 61 as above, the predetermined pressure that does not affect the operation (start or brake) of the swing hydraulic motor 24 during the regeneration is ensured in the actuator hydraulic line 101*a* or 101*b*.

The regeneration hydraulic motor 61 is rotationally driven by the hydraulic fluid from the actuator hydraulic line 101*a* or 101*b* on the higher pressure side. The regeneration electric motor 62 recovers output power of the regeneration hydraulic motor 61. The electricity thus generated is stored in the battery 65 via the inverter 63 and the chopper 64. The hydraulic fluid that has rotationally driven the regeneration hydraulic motor 51 returns to the tank 44.

Operation

A description is given of the operation of the swing drive system configured as above.

At the Time of Starting Up Swing

When the operator intends to start up swing and operates the control lever of the swing operation device 45 from the neutral position, the spool valve 43 is switched to position A or B. The hydraulic fluid discharged from the hydraulic pump 23 is supplied to port A or B of the swing hydraulic motor 24 via the actuator hydraulic line 101*a* or 101*b* to rotationally drive the swing hydraulic motor 24. Since the upper swing structure 20 driven by the swing hydraulic motor 24 is an inertial load, the pressure (the start-up pressure) of the actuator hydraulic line 101*a* or 101*b* on the higher pressure side will increase. When this start-up pressure increases to the first predetermined pressure Pa as the switching pressure of the first valve device 51, the first valve device 51 is switched from close position C to open position D. Here, the opening area of the throttle passage 51*a* of open position D is set to a degree at which the pressures in the actuator hydraulic lines 101*a*, 101*b* can increase up to the set pressure Prmax of the swing relief valves 48*a*, 48*b*. Therefore, even when the first valve device 51 is switched to open position D, the start-up pressure can increase up to the set pressure Prmax of the swing relief valves 48*a*, 48*b*, which allows the swing hydraulic motor 24 to start up smoothly and does not affect the swing start-up operation (function 1). The first valve device 51 is located at close position C until the start-up pressure increases up to the first predetermined pressure Pa. Even if there is a leak flow from the regeneration hydraulic motor 61 to the tank 44 while the first valve device 51 is at close position C, a leak of the hydraulic fluid from the actuator hydraulic line 101*a* or 101*b* on the higher pressure side will be limited to zero. An energy loss can thereby be prevented.

When the start-up pressure increases up to the first predetermined pressure Pa and the first valve device 51 is switched from close position C to open position D, the first regeneration hydraulic line 102 and the second regeneration hydraulic line 103 communicate with each other via the throttle passage 51*a* of the first valve device 51. The regeneration hydraulic motor 61 is controlled by the controller 70 so that the rotational speed is kept at zero until the pressure in the second regeneration hydraulic line 103 reaches the third predetermined pressure Pc. When the second regeneration hydraulic line 103 communicates with the first regeneration hydraulic line 102 and the pressure in the second regeneration line 103 increases to reach the second predetermined pressure Pb as the switching pressure of the second valve device 52, the second valve device 52 is switched from close position E to open position F. When the pressure in the second regeneration hydraulic line 103 further increases to reach the third predetermined pressure Pc, the regeneration hydraulic motor 61 is rotationally driven by the hydraulic fluid that flows in the second regeneration hydraulic line 103 from the actuator hydraulic line 101*a* or 101*b* on the higher pressure side via the second valve device 52. The rotational drive energy of the regeneration hydraulic motor 61 is converted by the regeneration electric motor 62 into electric energy that is in turn stored in the battery 65 (the regenerating operation is carried out). At this time, the second valve device 52 is located at open position F. The opening area of open position F is set to be large enough to minimize a pressure loss caused when the hydraulic fluid is discharged from the hydraulic operating line 101*a* or 101*b* on the higher pressure side to the regeneration hydraulic motor 61. The energy loss during the regeneration is thus small enough to highly efficiently regenerate energy (function 2). The regeneration hydraulic motor 61 is controlled so that the pressure in the second regeneration hydraulic line 103 is held at the third predetermined pressure Pc. The third predetermined pressure Pc is set at a value roughly equal to or slightly lower than the set pressure Prmax of the swing relief valves 48*a*, 48*b*. The start-up pressure of the swing hydraulic motor 24 is thereby ensured during regeneration.

When the rotational speed of the swing hydraulic motor 24 increases and the start-up pressure falls below the third predetermined pressure Pc, the regeneration hydraulic motor 61 is controlled so that the rotational speed becomes zero and the regeneration stops. When the start-up pressure further decreases to be lower than the second predetermined pressure Pb, the second valve device 52 is switched to close position E. When the start-up pressure further falls below the first predetermined pressure Pa, the first valve device 51 is switched to close position C.

At the Time of Stopping Swing

When the operator returns the control lever of the swing operation device 45 to the neutral position in order to stop the swing operation, the spool valve 43 is switched from position A or position B to the neutral position. In such a case, the supply of the hydraulic fluid from the hydraulic pump 23 to the swing hydraulic motor 24 stops and the discharge of the hydraulic fluid from the swing hydraulic motor 24 to the tank 44 via the spool valve 43 is interrupted. The upper swing structure 20 driven by the swing hydraulic motor 24 is an inertial load. Therefore, even when the supply of the hydraulic fluid from the hydraulic pump stops, the swing hydraulic motor 24 will continue rotating with the inertia of the upper swing structure 20. The hydraulic fluid is supplied to the swing hydraulic motor 24 from the tank 44 via the check valve 49*a* or 49*b* and is continuously discharged from the swing hydraulic motor 24. Thus, the pressure in the actuator hydraulic line 101*a* or 101*b* on the discharge side increases and is applied as brake pressure to the swing hydraulic motor 24. When this brake pressure increases up to the first predetermined pressure Pa as the switching pressure of the first valve device 51, the first valve device 51 is switched from close position C to open position D. Here, the opening area of the throttle passage 51*a* of open position D is set to a degree at which the pressure in the actuator hydraulic lines 101*a*, 101*b* can increase up to the set pressure Prmax of the swing relief valves 48*a*, 48*b*. Therefore, even when the first valve device 51 is switched to open position D, the brake pressure can increase up to the set pressure Prmax of the swing relief valves 48*a*, 48*b*. The brake pressure is applied to the swing hydraulic motor 24 in a conventional manner without affecting the swing braking operation (function 1). The first valve device 51 is located at close position C until the brake pressure increases up to the first predetermined pressure Pa. Even if there is a leak flow from the regeneration hydraulic motor 61 to the tank 44 while the first valve device 51 is at close position C, a leak of the hydraulic fluid from the actuator hydraulic line 101*a* or 101*b* on the higher pressure side will be limited to zero. The brake pressure can thereby be increased for sure.

When the brake pressure increases to the first predetermined pressure Pa to switch the first valve device 51 from close position C to open position D, the first regeneration hydraulic line 102 and the second hydraulic line 103 communicate with each other via the throttle passage 51*a* of the first valve device 51. The regeneration hydraulic motor 61 is controlled by the controller 70 so as to keep the rotational speed zero until the pressure in the second regeneration hydraulic line 103 reaches the third predetermined pressure. When the second regeneration hydraulic line 103 communicates with the first regeneration line 102 and the pressure in the second regeneration hydraulic line 103 increases up to the second predetermined pressure Pb as the switching pressure of the second valve device 52, the second valve device 52 is switched from close position E to open position F. When the pressure in the second regeneration hydraulic line 103 further increases to reach the third predetermined pressure Pc, the regeneration hydraulic motor 61 is rotationally driven by the hydraulic fluid that flows in the second regeneration hydraulic line 103 from the actuator hydraulic line 101*a* or 101*b* on the discharge side (on the higher pressure side) via the second valve device 52. The rotational drive of the regeneration hydraulic motor 61 is converted by the regeneration electric motor 62 into electric energy that is in turn stored in the battery 65 (regeneration is carried out). At this time, the second valve device 52 is located at open position F. The opening area of open position F is set to be large enough to minimize a pressure loss caused when the hydraulic fluid is discharged from the hydraulic operating line 101*a* or 101*b* on the discharge side (on the higher pressure side) to the regeneration hydraulic motor 61. The energy loss during the regeneration is thus small enough to highly efficiently regenerate the energy (function 2). The regeneration hydraulic motor 61 is controlled so that the pressure in the second regeneration hydraulic line 103 is held at the third predetermined pressure Pc. The third predetermined pressure Pc is set at a value roughly equal to or slightly lower than the set pressure Prmax of the swing relief valves 48*a*, 48*b*. The brake pressure of the swing hydraulic motor 24 is thus ensured during regeneration without affecting the operation during the braking.

When the rotational speed of the swing hydraulic motor 24 lowers and the brake pressure falls below the third predetermined pressure Pc, the regeneration hydraulic motor 61 is controlled to make the rotational speed zero and the regeneration stops. When the brake pressure further falls below the second predetermined pressure Pb, the second valve device 52 is switched to close position E. When the brake pressure further falls below the first predetermined pressure Pa, the first valve device 51 is switched to close position C. The swing hydraulic motor 24 subsequently stops.

At the Time of Troubles During Regeneration

During regeneration, the regeneration hydraulic motor 61 may come into a free-run state due to a trouble in an electric system (e.g., failure of the regeneration electric motor 62) and the third predetermined pressure Pc may not be held. In such a case, the pressure in the second regeneration hydraulic line 103 will fall below the second predetermined pressure Pb, switching the second valve device 52 to close position E. Thus, the communication is interrupted between the actuator hydraulic line 101*a* or 101*b* on the higher pressure side and the second regeneration hydraulic line 103 via the second valve device 52. Although the first valve device 51 is located at open position D, the start-up pressure or the brake pressure can increase up to the set pressure Prmax of the swing relief valves 48*a*, 48*b* by employing the above-mentioned setting of the throttle passage 51*a*. The pressure in the actuator hydraulic line 101*a* or 101*b* on the higher pressure side consequently increases up to the set pressure Prmax of the swing relief valve 48*a*, 48*b*. At the time of starting up the swing, the swing hydraulic motor 24 can start up smoothly. At the time of stopping the swing, the swing hydraulic motor 24 can stop without unintended motion (function 3). The regeneration valve block 50 in itself does not include an electric system at all and is composed of only the hydraulic devices (the first valve device 51 and the second valve device 52) having few trouble factors. Even if some trouble occurs around the regeneration hydraulic motor 61, the regeneration valve block 50 will appropriately operate, offering high reliability.

Advantageous Effects

As described above, the energy regeneration system of the present embodiment achieves functions 1 to 3 that the regeneration hydraulic motor 61 is required to have at the time of regenerating energy. The regeneration valve block 50 is composed of only the hydraulic devices (the first valve device 51 and the second valve device 52) having few trouble factors. Therefore, even if some trouble occurs around the regeneration hydraulic motor 61, swing can be started or braked in a normal way, offering high reliability.

The first valve device 51 is configured as the hydraulic pilot switching valve that is switched from close position C to open position D having the throttle passage 51*a* when the pressure in the actuator hydraulic line 101*a* or 101*b* on the higher pressure side increases up to the first predetermined pressure Pa. The hydraulic fluid thus will not flow out of the actuator hydraulic line 101*a* or 101*b* on the higher pressure side until the start-up pressure or the brake pressure increases to the first predetermined pressure Pa. That is, the leak of the hydraulic fluid is limited to zero, preventing an energy loss at a pressure not higher than the first predetermined pressure Pa and thus increasing the brake pressure at the time of braking for sure.

Second Embodiment

Figure 3:
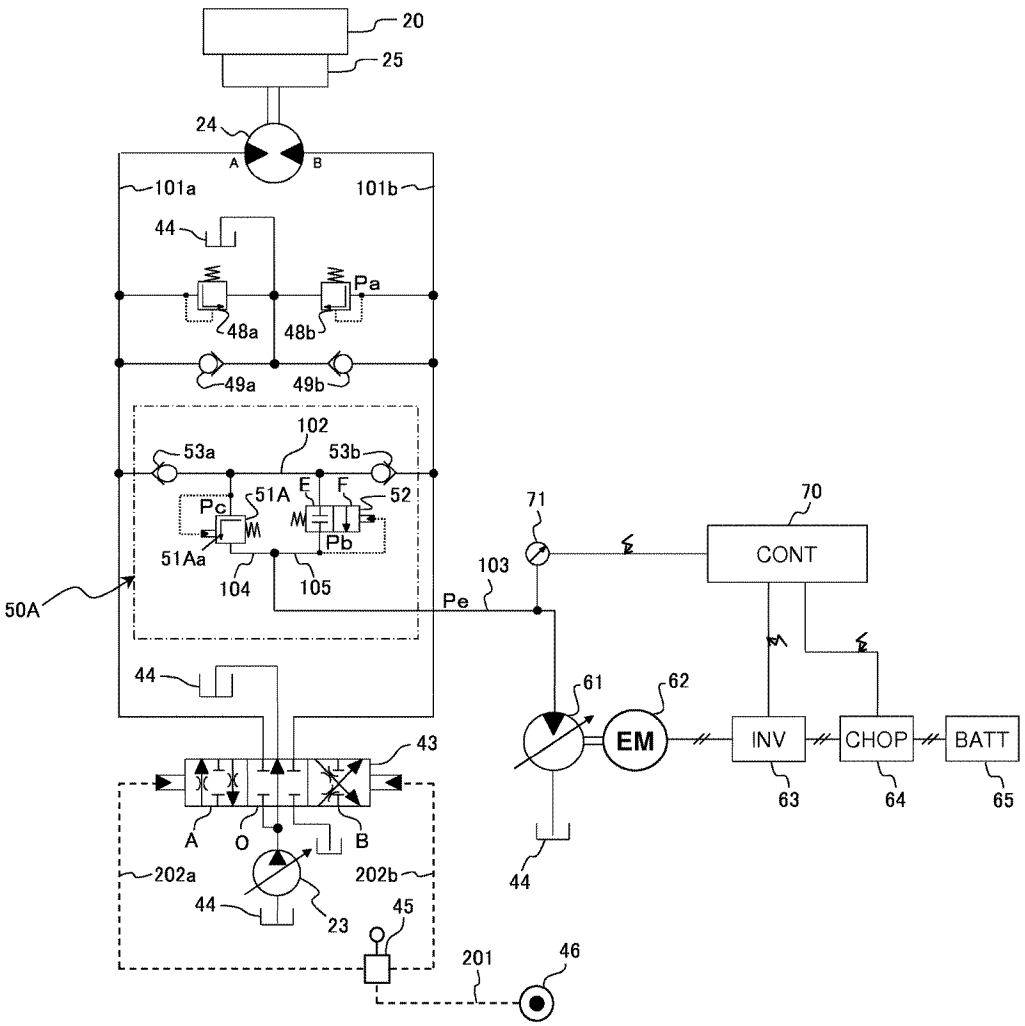
FIG. 3 is a diagram showing the overall configuration of a swing drive system of the construction machine provided with an energy regeneration system according to a second embodiment of the present invention.

FIG. 3 is a diagram showing the overall configuration of a swing drive system of a construction machine provided with an energy regeneration system according to a second embodiment of the present invention. In the figure, the same members as those in the swing drive system in the first embodiment shown in FIG. 2 are marked with the same reference numerals and their explanations are omitted.

The energy regeneration system of the present embodiment is different from that of the first embodiment (see FIG. 2) in that a first valve device 51A of a regeneration valve block 50A is configured as a small-sized pilot relief valve in place of the pilot switching valve.

More specifically, the regeneration valve block 50A has the pilot relief valve as the first valve device 51A. The pilot relief valve as the first valve device 51A is closed while the pressure in an actuator hydraulic line 101*a* or 101*b* on the higher pressure side is lower than a first predetermined pressure Pa. When the pressure in the actuator hydraulic line 101*a* or 101*b* on the higher pressure side increases to reach a first predetermined pressure Pa, the pilot relief valve opens to come into a relief state in which a throttle passage 51Aa is activated. If it is assumed that the set pressure of swing relief valves 48*a*, 48*b* is Prmax, the first predetermined pressure Pa is set at a pressure slightly lower than Prmax. The opening area of the throttle passage 51Aa of the pilot relief valve is set to such a degree that, during start or stop of swing, hydraulic fluid of a low flow rate flows, the flow rate being small enough to allow the pressure in the actuator hydraulic lines 101*a* or 101*b* on the higher pressure side to increase to the set pressure Prmax of the swing relief valves 48*a*, 48*b*. Such a configuration of the pilot relief valve achieves above-mentioned function 1.

The operation of the energy regeneration system of the present embodiment is practically the same as that of the first embodiment shown in FIG. 2, and the present embodiment also achieves the same advantageous effects as those of the first embodiment.

Third Embodiment

Figure 4:
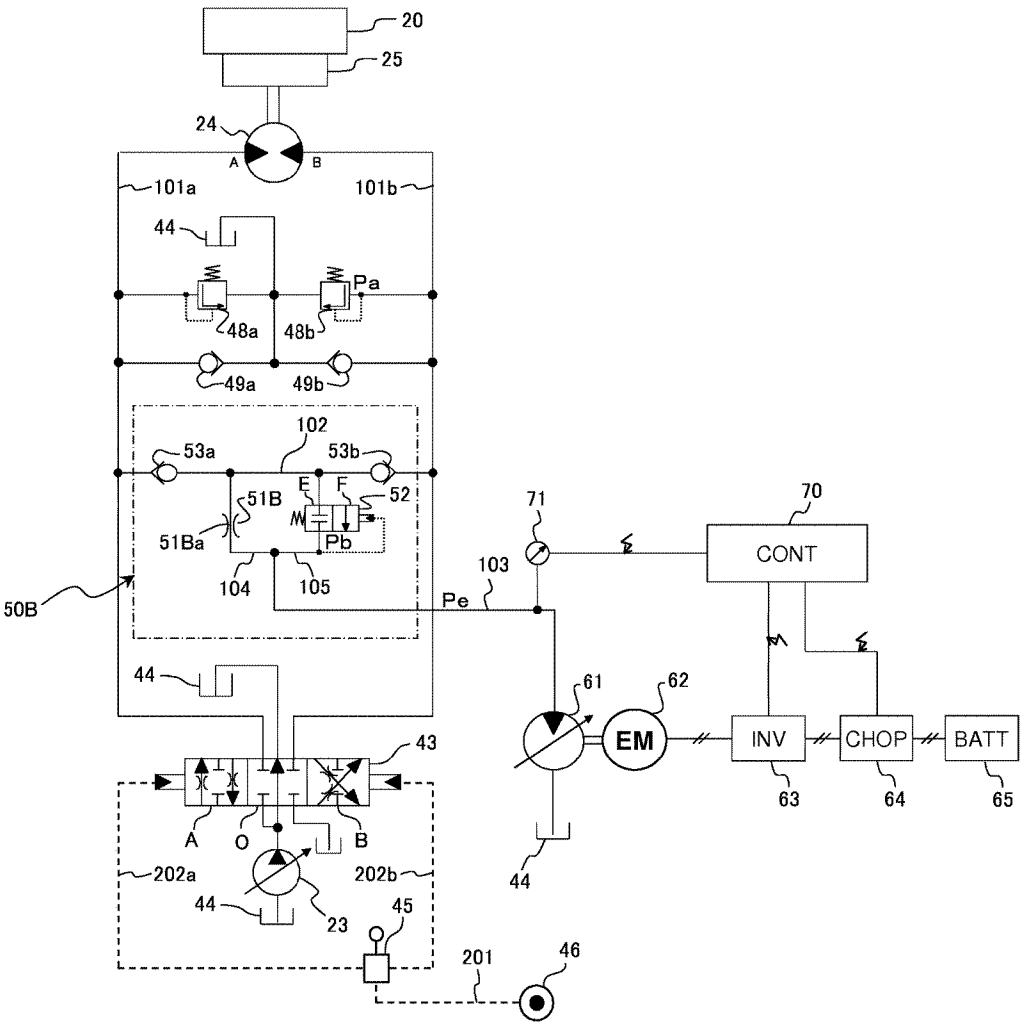
FIG. 4 is a diagram showing the overall configuration of a swing drive system of the construction machine provided with an energy regeneration system according to a third embodiment of the present invention.

FIG. 4 is a diagram showing the overall configuration of a swing drive system of a construction machine provided with an energy regeneration system according to a third embodiment of the present invention. In the figure, the same members as those in the swing drive system in the first embodiment shown in FIG. 2 are marked with the same reference numerals and their explanations are omitted.

The energy regeneration system of the present embodiment is different from that of the first embodiment (see FIG. 2) in that a first valve device 51B of a regeneration valve block 50B is configured as a fixed restrictor 51B in place of the pilot switching valve.

More specifically, the regeneration valve block 50B has a fixed restrictor as the first valve device 51B. The opening area of the throttle passage 51Ba of the fixed restrictor is set to such a degree that, during the start or stop of swing, hydraulic fluid of a low flow rate flows, the flow rate being small enough to allow the pressure in the actuator hydraulic lines 101*a* or 101*b* on the higher pressure side to increase to the set pressure Prmax of the swing relief valves 48*a*, 48*b*. Such a configuration of the fixed restrictor achieves above-mentioned function 1.

As with the first embodiment, the swing braking device in the present embodiment will start or brake swing even if some trouble occurs around the regeneration hydraulic motor 61, offering high reliability. In the present embodiment, since the first valve device 51B is composed of the fixed restrictor, the configuration of the first valve device 51B is simplified and thus the regeneration valve block 50B can be manufactured inexpensively.

Fourth Embodiment

Figure 5:
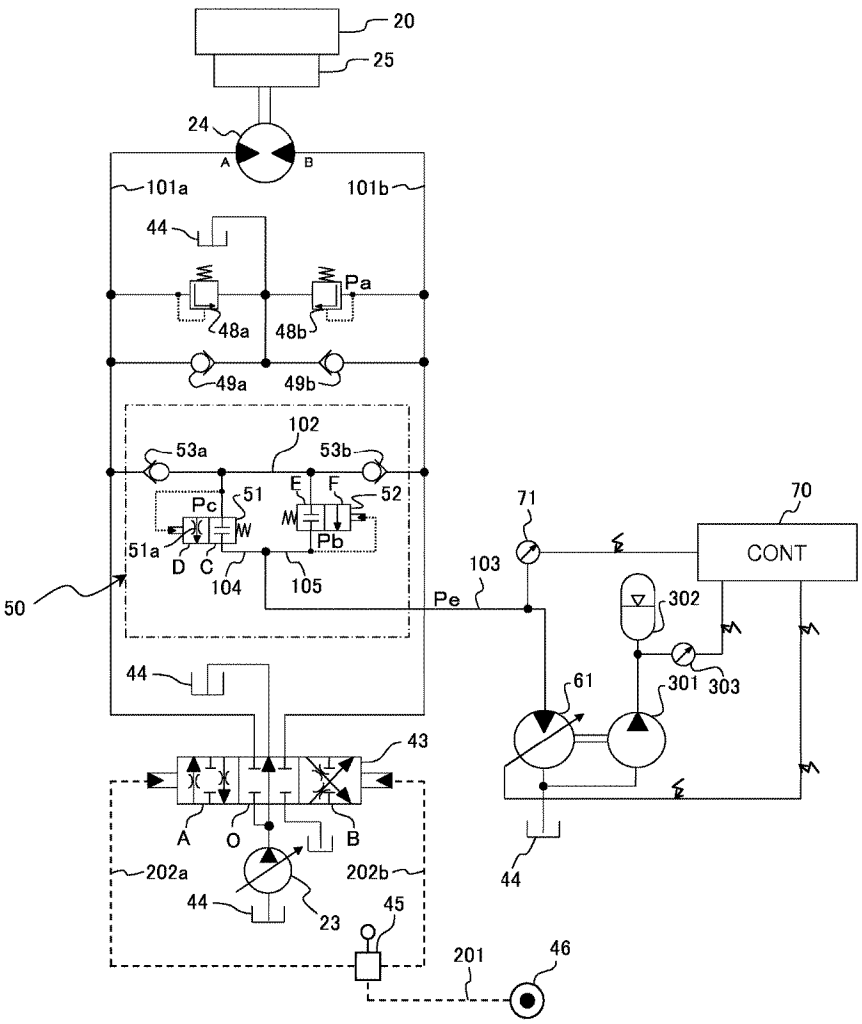
FIG. 5 is a diagram showing the overall configuration of a swing drive system of the construction machine provided with an energy regeneration system according to a fourth embodiment of the present invention.

FIG. 5 is a diagram showing the overall configuration of a swing drive system of a construction machine provided with an energy regeneration system according to a fourth embodiment of the present invention. In the figure, the same members as those in the swing drive system in the first embodiment shown in FIG. 2 are marked with the same reference numerals and their explanations are omitted.

The energy regeneration system of the present embodiment is different from that of the first embodiment (see FIG. 2) in that the regeneration electric motor 62 is replaced with a regeneration hydraulic pump 301 as a regeneration energy recovering device, the battery 65 storing regeneration energy is replaced with an accumulator 302, and the regeneration energy is recovered as hydraulic energy.

More specifically, the energy recovery system includes, in addition to the recovery hydraulic motor 61, the recovery hydraulic pump 301 connected mechanically to the regeneration hydraulic motor 61, an accumulator 302 connected to a discharge port of the regeneration hydraulic pump 301, a pressure sensor 303 connected to the discharge port of the regeneration hydraulic pump 301, and the controller 70 connected to the regeneration hydraulic motor 61 and the pressure sensor 303.

The controller 70 issues a command to the regeneration hydraulic motor 61 to have zero tilt, keeping its rotational speed at zero until the pressure in the second regeneration hydraulic line 103 detected by the pressure sensor 71 reaches the third predetermined pressure Pc. When the pressure in the second regeneration hydraulic line 103 exceeds the third predetermined pressure Pc, the controller 70 rotates the regeneration hydraulic motor 61. The controller 70 further controls the tilt of the regeneration hydraulic motor 61 using signals from the pressure sensor 71 and the pressure sensor 303 so that the pressure in the second regeneration hydraulic line 103 is held at the third predetermined pressure Pc.

The regeneration hydraulic motor 61 is rotationally driven by the hydraulic fluid from the actuator hydraulic line 101*a* or 101*b* on the higher pressure side. The regeneration hydraulic pump 301 recovers output power of the regeneration hydraulic motor 61. The hydraulic energy thus generated is stored in the accumulator 302. The hydraulic fluid that has rotationally driven the regeneration hydraulic motor 61 returns to the tank 44.

As with the first embodiment, the swing braking device in the present embodiment will start or brake swing even if some trouble occurs around the regeneration hydraulic motor 61, offering high reliability.

Fifth Embodiment

Figure 6:
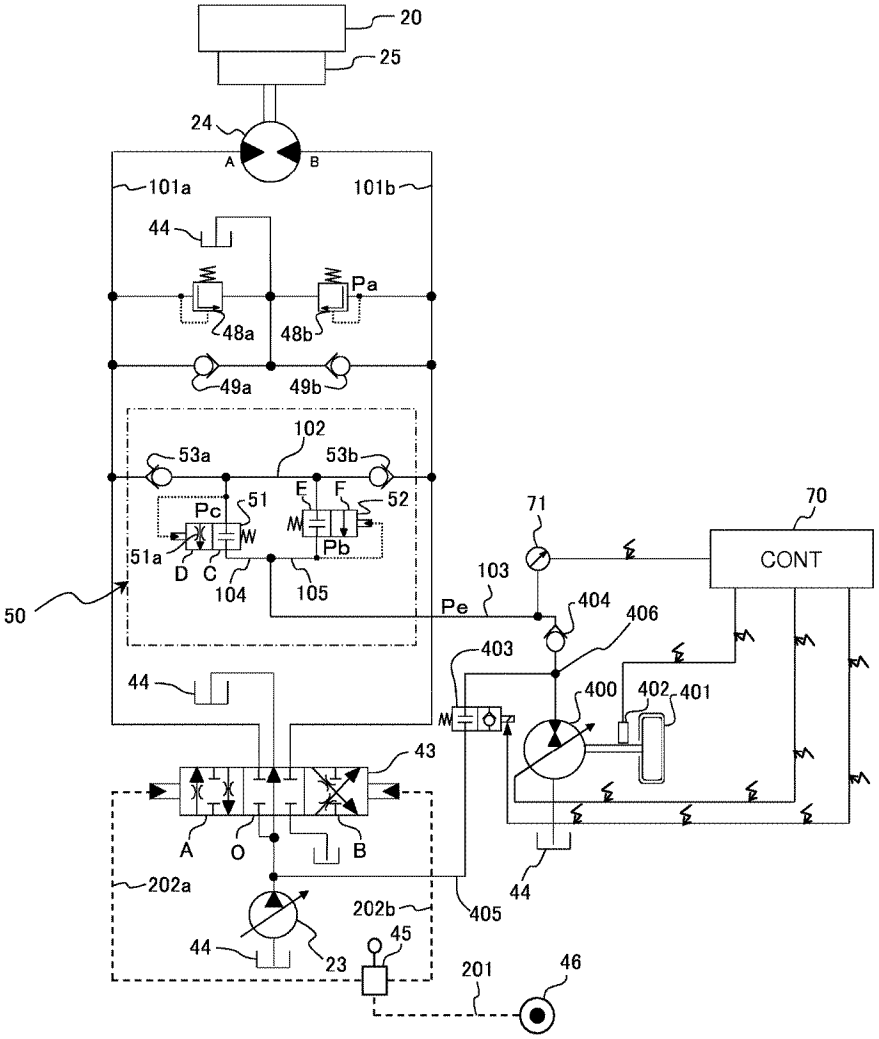
FIG. 6 is a diagram showing the overall configuration of a swing drive system of the construction machine provided with an energy regeneration system according to a fifth embodiment of the present invention.

FIG. 6 is a diagram showing the overall configuration of a swing drive system of a construction machine provided with an energy regeneration system according to a fifth embodiment of the present invention. In the figure, the same members as those in the swing drive system in the first embodiment shown in FIG. 2 are marked with the same reference numerals and their explanations are omitted.

The energy regeneration system of the present embodiment is different from that of the first embodiment (see FIG. 2) in that the regeneration hydraulic motor 61 is replaced with a regeneration hydraulic pump motor 400 as a regeneration hydraulic motor to which a hydraulic pump function is added, the regeneration electric motor 62 is replaced with a flywheel 401 as a regeneration energy recovery device, and regeneration energy is recovered as kinetic energy.

More specifically, the energy regeneration system includes, in addition to the regeneration hydraulic pump motor 400, the flywheel 401 connected mechanically to the regeneration hydraulic pump motor 400, a rotational speed sensor 402 for detecting the rotational speed of the flywheel 401, the controller 70 connected to the regeneration hydraulic pump motor 400 and the rotational speed sensor 402, a switching valve with a backflow prevention function provided on a hydraulic line 405 connected to the discharge side hydraulic line of the hydraulic pump 23, and a check valve 404 provided on the second regeneration hydraulic line 103 and located on the upstream side of a branching point 406 to the hydraulic line 405.

The regeneration hydraulic pump motor 400 is of, for example, an axial piston type having a double-tilting mechanism. The regeneration hydraulic pump motor 400 is driven as a hydraulic motor by the hydraulic fluid discharged from the actuator hydraulic line 101*a* or 101*b* on the higher pressure side during regeneration and supplies kinetic energy to the flywheel 401. During power running, the regeneration hydraulic pump motor 400 tilts inversely with during the operation as the motor and is driven as a hydraulic pump by the kinetic energy stored in the flywheel 40. This tilt control is performed in response to a command from the controller 70. Until the pressure in the second regeneration hydraulic line 103 detected by the pressure sensor 71 reaches the third predetermined pressure Pc, the controller 70 keeps the rotational speed at zero by causing the regeneration hydraulic pump motor 400 to have zero tilt. When the pressure in the second regeneration hydraulic line 103 exceeds the third predetermined pressure Pc, the controller 70 rotates the regeneration hydraulic pump motor 400. The controller 70 further controls the tilt of the regeneration hydraulic pump motor 400 using signals from the pressure sensor 71 and the rotational speed sensor 402 so that the pressure in the second regeneration hydraulic line 103 is held at the third predetermined pressure Pc.

The regeneration hydraulic pump motor 400 is rotationally driven by the hydraulic fluid from the actuator hydraulic line 101*a* or 101*b* on the higher pressure side. The hydraulic energy generated by the regeneration hydraulic pump motor 400 is recovered as kinetic energy by the flywheel 401. The hydraulic fluid that has rotationally driven the regeneration hydraulic pump motor 400 returns to the tank 44.

When the regeneration hydraulic pump motor 400 is on power running, the controller 70 controls the regeneration hydraulic pump motor 400 to tilt inversely with during the operation as the motor as described above and switches the switching valve 403 from the close position to the open position. Consequently, the hydraulic fluid discharged from the regeneration hydraulic pump motor 400 flows into the discharge side of the hydraulic pump 23. At this time, the check valve 404 blocks the inflow of the hydraulic fluid into the regeneration valve block 50.

As with the first embodiment, the swing braking device in the present embodiment will start or brake swing even if some trouble occurs around the regeneration hydraulic motor 61, offering high reliability.

Sixth Embodiment

Figure 7:
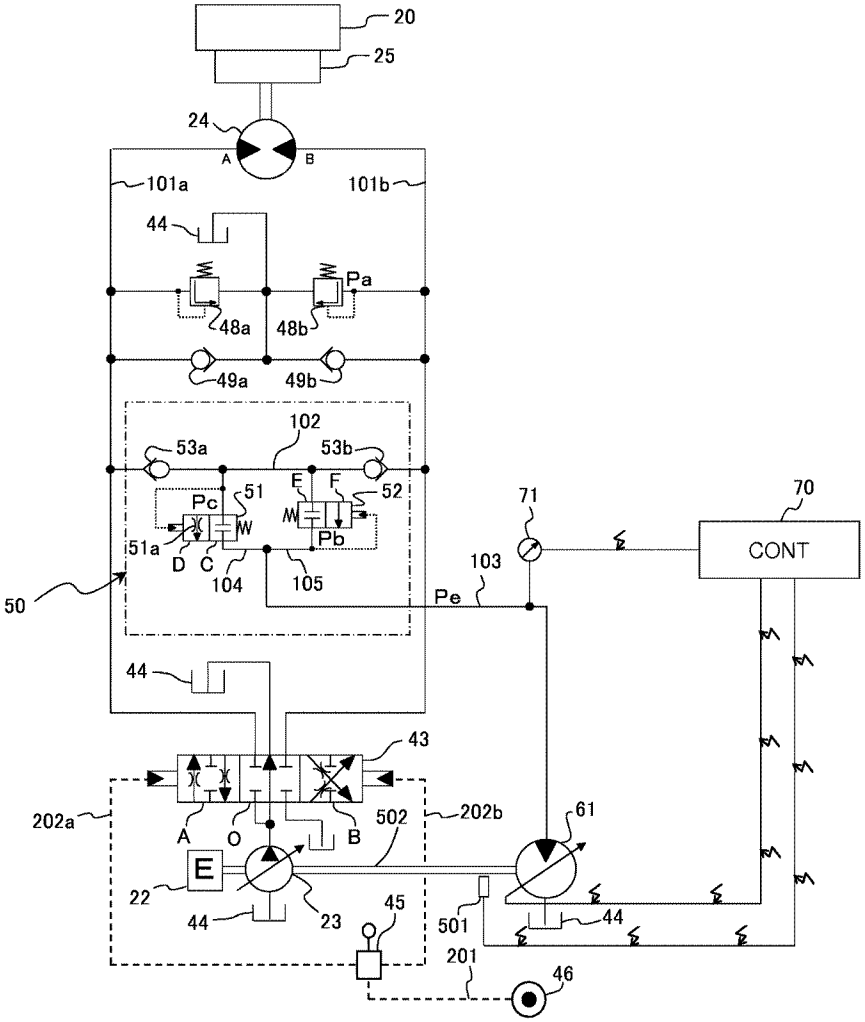
FIG. 7 is a diagram showing the overall configuration of a swing drive system of the construction machine provided with an energy regeneration system according to a sixth embodiment of the present invention.

FIG. 7 is a diagram showing the overall configuration of a swing drive system of a construction machine provided with an energy regeneration system according to a sixth embodiment of the present invention. In the figure, the same members as those in the swing drive system in the first embodiment shown in FIG. 2 are marked with the same reference numerals and their explanations are omitted.

The energy regeneration system of the present embodiment is different from that of the first embodiment (see FIG. 2) in that the regeneration hydraulic motor 61 is connected mechanically to an engine 22 and a hydraulic pump 23, which are regeneration energy recovery devices, and generation energy is recovered as kinetic energy.

More specifically, the energy regeneration system includes, in addition to the regeneration hydraulic motor 61, the engine 22 and the hydraulic pump 23 connected mechanically to the regeneration hydraulic motor 61 via a shaft 502, a rotational speed sensor 501 for detecting the rotational speed of the regeneration hydraulic motor 61, and a controller 70 connected to the regeneration hydraulic motor 61 and the rotational speed sensor 501.

Until the pressure in the second regeneration hydraulic line 103 detected by the pressure sensor 71 reaches the third predetermined pressure Pc, The controller 70 keeps the flow rate at zero by causing the regeneration hydraulic motor 61 to have zero tilt. When the pressure in the second regeneration hydraulic line 103 exceeds the third predetermined pressure Pc, the controller 70 rotates the regeneration hydraulic motor 61. The controller 70 further controls the tilt of the regeneration hydraulic motor 61 using signals from the pressure sensor 71 and the rotational speed sensor 501 so that the pressure in the second regeneration hydraulic line 103 is held at the third predetermined pressure Pc.

The regeneration hydraulic motor 61 is rotationally driven by the hydraulic fluid from the actuator hydraulic line 101*a* or 101*b* on the higher pressure side. The hydraulic energy thus regenerated is transmitted as kinetic energy by the shaft 502 to the hydraulic pump 23 and the engine 22 and then recovered. The hydraulic fluid that has rotationally driven the regeneration hydraulic motor 61 returns to the tank 44.

As with the first embodiment, the swing braking device in the present embodiment will start or brake swing if some trouble occurs around the regeneration hydraulic motor 61, offering high reliability.

Seventh Embodiment

Figure 8:
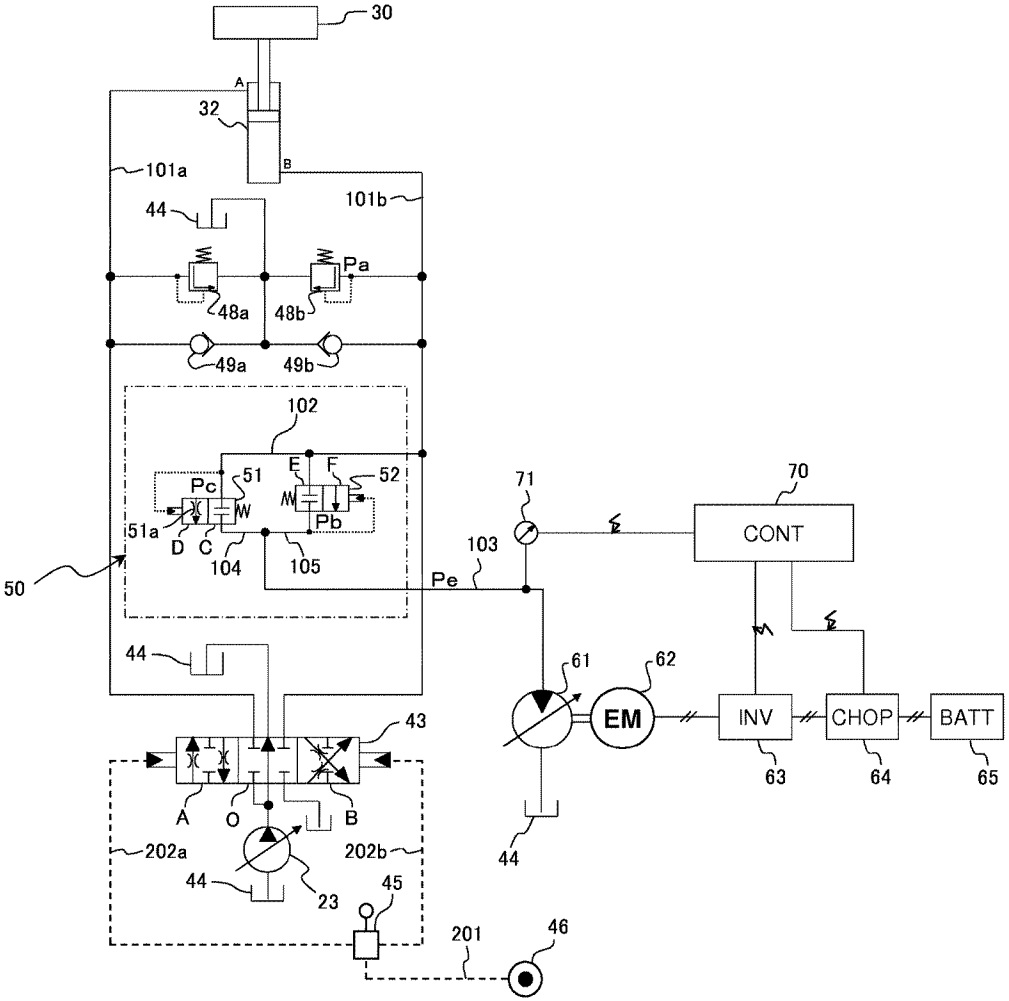
FIG. 8 is a diagram showing the overall configuration of a swing drive system of the construction machine provided with an energy regeneration system according to a seventh embodiment of the present invention.

FIG. 8 is a diagram showing the overall configuration of a swing drive system of a construction machine provided with an energy regeneration system according to a seventh embodiment of the present invention. In the figure, the same members as those of the swing drive system in the first embodiment shown in FIG. 2 are marked with the same reference numerals and their explanations are omitted.

The energy regeneration system of the present embodiment is different from the first embodiment (see FIG. 2) in that the swing hydraulic motor 24 is replaced with a boom cylinder 32 and a first regeneration hydraulic line 102 is connected only to an actuator hydraulic line 101*b*. In a situation that the relief valve relieves hydraulic pressure, energy can be recovered similarly to the first embodiment. The present embodiment is therefore applicable to such a situation and achieves the same advantageous effects as those of the first embodiment.

Others

The above embodiments can be modified in various ways within the range of the spirit of the present invention. For example, in the above-described embodiments, the present invention is applied to the swing drive system. However, the present invention can be applied to a travel drive system using a travel hydraulic motor (not shown) as well. Additionally, the present invention can be applied to a boom drive system that includes a boom cylinder driving a boom capable of recovering energy resulting from self-weight dropping. Alternatively, the present invention can be applied to an arm drive system that includes an arm cylinder driving an arm. Each of these applications achieves the same advantageous effects.

The above embodiments describe cases in which the construction machine is a hydraulic excavator. However, the present invention can be applied to construction machines (e.g., hydraulic cranes, wheel type excavators, etc.) other than hydraulic excavators as long as such construction machines have a hydraulic actuator driving an inertial load. Each of these applications achieves the same advantageous effects.

In the above embodiments, the hydraulic pump 23 is driven by the engine 22. However, it may be driven by an electric motor in place of the engine 22. In this case, the battery 65 may be used as an electrical power source of the electric motor.

DESCRIPTION OF REFERENCE CHARACTERS

10: Lower track structure
11: Crawler
12: Crawler frame
13, 14: Hydraulic motor for travel
20: Upper swing structure
21: Swing frame
22: Engine (regeneration energy recovery device)
23: Hydraulic pump (regeneration energy recovery device)
24: Swing hydraulic motor
25: Speed reducer
26: Control valve
30: Excavating mechanism
31: Boom
32: Boom cylinder
33: Arm
34: Arm cylinder
35: Bucket
36: Bucket cylinder
43: Spool valve (swing control device)
44: Tank
45: Swing operation device
46: Pilot pressure source
48*a*, 48*b*: Swing relief valve
49*a*, 49*b*: Check valve
50, 50A, 50B: Regeneration valve block
51: First valve device (pilot switching valve)
51A: First valve device (pilot relief valve)

51B: First valve device (fixed restrictor)
51*a*, 51*a*A, 51Ba: Throttle passage
52: Second valve device (Pilot switching valve)
53*a*, 53*b*: Check valve
61: Regeneration hydraulic motor
62: Regeneration electric motor (regeneration energy recovery device)
63: Invertor
64: Chopper
65: Battery
70: Controller
71: Pressure sensor
101*a*, 101*b*: Actuator hydraulic line
102: First regeneration hydraulic line
103: Second regeneration hydraulic line
104: Third regeneration hydraulic line
105: Fourth regeneration hydraulic line
202*a*, 202*b*: Hydraulic line
301: Regeneration hydraulic pump (regeneration energy recovery device)
302: Accumulator
400: Recovery hydraulic pump motor (recovery hydraulic motor)
401: Flywheel (regeneration energy recovery device)
502: Shaft

The invention claimed is:

1. An energy regeneration system for a construction machine, comprising:

a hydraulic pump;

a hydraulic actuator driven by hydraulic fluid supplied from the hydraulic pump;

a control valve that supplies the hydraulic fluid from the hydraulic pump to the hydraulic actuator in response to an operation command from an operation device so as to control a drive direction and speed of the hydraulic actuator;

relief valves installed on two actuator hydraulic lines connecting the control valve and the hydraulic actuator together, the relief valves being adapted to control pressures in the actuator hydraulic lines not to exceed a set pressure;

a regeneration hydraulic motor rotationally driven by a hydraulic fluid discharged from a higher pressure side of the two actuator hydraulic lines when pressure in the higher pressure side actuator hydraulic line increases to the set pressure of the relief valve; and a regeneration energy recovery device, connected to the regeneration hydraulic motor, for recovering output power of the regeneration hydraulic motor;

wherein the energy regeneration system further comprising:

a first valve device disposed between the regeneration hydraulic motor and at least the higher pressure side of the two actuator hydraulic lines, the first valve device having a throttle passage allowing the pressure in the higher pressure side actuator hydraulic line to increase to the set pressure of the relief valve; and a second valve device disposed in parallel with the first valve device between the regeneration hydraulic motor and at least the higher pressure side of the two actuator hydraulic lines, the second valve device being adapted to be switched from a close position to an open position by the pressure between the first valve device and the regeneration hydraulic motor when the pressure between the first valve device and the regeneration hydraulic motor increases to approach the set pressure of the relief valve.

2. The energy regeneration system for a construction machine according to claim 1, wherein the first valve device is a hydraulic pilot switching valve that is switched from a close position to an open position including the throttle passage when the pressure in the higher pressure side actuator hydraulic line increases to approach the set pressure of the relief valve.

3. The energy regeneration system for a construction machine according to claim 1, wherein the first valve device is a relief valve that activates the throttle passage when the pressure in the higher pressure side actuator hydraulic line increases to approach the set pressure of the relief valve.

4. The energy regeneration system for a construction machine according to claim 1, wherein the first valve device is a fixed restrictor forming the throttle passage.

5. The energy regeneration system for a construction machine according to claim 1, further comprising:

a pressure sensor for detecting pressure between the first valve device and the regeneration hydraulic motor; and a control unit that controls the regeneration hydraulic motor or the regeneration energy recovery device so as to keep rotational speed of the regeneration hydraulic motor at zero until the pressure detected by the pressure sensor reaches a predetermined pressure at which operation of the hydraulic actuator is not affected, and so as to rotate the regeneration hydraulic motor and hold the pressure detected by the pressure sensor at the predetermined pressure when the pressure detected by the pressure sensor exceeds the predetermined pressure.

* * * * *